US009391418B2

(12) United States Patent
Stull et al.

(10) Patent No.: US 9,391,418 B2
(45) Date of Patent: Jul. 12, 2016

(54) TERMINAL CRIMPING DEVICE FOR DETERMINING A CRIMP HEIGHT OF A CRIMPED ELECTRICAL CONNECTION

(71) Applicant: Tyco Electronics Corporation, Berwyn, PA (US)

(72) Inventors: David Michael Stull, Etters, PA (US); John Dunaway Charlton, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 295 days.

(21) Appl. No.: 13/965,854

(22) Filed: Aug. 13, 2013

(65) Prior Publication Data

US 2015/0047189 A1 Feb. 19, 2015

(51) Int. Cl.
*H01R 43/042* (2006.01)
*H01R 43/048* (2006.01)

(52) U.S. Cl.
CPC ..... *H01R 43/0486* (2013.01); *H01R 43/0488* (2013.01); *Y10T 29/49185* (2015.01); *Y10T 29/53235* (2015.01)

(58) Field of Classification Search
CPC ..... G01N 29/04; G01N 29/07; G01N 29/221; G01N 29/265; H01R 43/048; H01R 43/0486; H01R 43/0488; H01R 43/058; H01R 43/0207; Y10T 29/53022; Y10T 29/53196; Y10T 29/53235; Y10T 29/5327
USPC ..... 29/705, 753; 73/588
See application file for complete search history.

(56) References Cited

U.S. PATENT DOCUMENTS

| | | | | |
|---|---|---|---|---|
| 4,018,499 | A * | 4/1977 | Rickards | 439/396 |
| 4,856,186 | A | 8/1989 | Yeomans | |
| 5,046,241 | A | 9/1991 | Ricard | |
| 5,123,165 | A | 6/1992 | Strong et al. | |
| 5,195,352 | A * | 3/1993 | Grois et al. | 72/409.16 |
| 5,197,186 | A | 3/1993 | Strong et al. | |
| 5,415,015 | A * | 5/1995 | Klemmer et al. | 72/412 |

(Continued)

FOREIGN PATENT DOCUMENTS

| | | |
|---|---|---|
| DE | 3737924 A1 | 5/1989 |
| WO | WO2012/106390 | 8/2012 |

OTHER PUBLICATIONS

International Search Report, International Application No. PCT/US2014/050262, International Filing Date, Aug. 8, 2014.

(Continued)

*Primary Examiner* — Paul D Kim

(57) ABSTRACT

A terminal crimping device includes crimp tooling including an anvil and a ram movable toward the anvil with a crimp zone being defined between the anvil and the ram configured to receive a wire and a terminal configured to be crimped to the wire by the crimp tooling. An ultrasonic transducer is coupled to at least one of the anvil and the ram that receives acoustic signals sent through the wire and terminal. A crimp quality module receives signals from the ultrasonic transducer. The crimp quality module determines a crimp height of the terminal based on the acoustic signal received by the ultrasonic transducer. Optionally, the crimp height may be determined based upon a transmission time of the acoustic signal from a transmitting transducer to a receiving transducer. The crimp height may be determined based upon a speed of sound transmission coefficient of the terminal and the wire.

14 Claims, 2 Drawing Sheets

(56) References Cited

U.S. PATENT DOCUMENTS

| | | | | |
|---|---|---|---|---|
| 5,570,514 | A * | 11/1996 | Hashimoto et al. | 33/784 |
| 5,692,294 | A * | 12/1997 | Casey | 29/753 |
| 7,181,942 | B2 | 2/2007 | Yost et al. | |
| 2003/0008548 | A1* | 1/2003 | Ueda et al. | 439/422 |
| 2005/0193792 | A1 | 9/2005 | Yost et al. | |
| 2011/0034091 | A1* | 2/2011 | Kobayashi et al. | 439/877 |
| 2012/0060585 | A1 | 3/2012 | Yost et al. | |
| 2012/0263344 | A1* | 10/2012 | Viviroli | 382/100 |
| 2013/0130567 | A1* | 5/2013 | Onuma et al. | 439/877 |
| 2013/0197823 | A1 | 8/2013 | Williams | |

OTHER PUBLICATIONS

Use of Thermography and Ultrasonic Inspection for Evaluation of Crimped Wire Connection Quality, 18th World Conference on Non-destructive Testing, Apr. 2012, 10 pgs, Durban, South Africa.

* cited by examiner

TERMINAL CRIMPING DEVICE FOR DETERMINING A CRIMP HEIGHT OF A CRIMPED ELECTRICAL CONNECTION

BACKGROUND OF THE INVENTION

The subject matter herein relates generally to methods and systems of determining a crimp height of a crimped electrical connection.

Terminals are typically crimped onto wires by means of a conventional crimping press having an anvil for supporting the electrical terminal and a ram that is movable toward and away from the anvil for crimping the terminal. In operation, a terminal is placed on the anvil, an end of a wire is inserted into the ferrule or barrel of the terminal, and the ram is caused to move toward the anvil to the limit of the stroke of the press, thereby crimping the terminal onto the wire. The ram is then retracted to its starting point.

In order to obtain a satisfactory crimped connection, the crimp height and other characteristics of the crimped terminal must be closely controlled. The crimp height of a terminal is a measure of height or maximum vertical dimension of a given portion of the terminal after crimping. Ordinarily, if a terminal is not crimped to the correct crimp height for the particular terminal and wire combination, an unsatisfactory crimped connection will result. Some systems measure crimp height by manual measurements of the terminals which can be slow and tedious. Some systems measure crimp height based on ram displacement measurements. For example, simple non-destructive means of detecting such defective crimped connections by accurately measuring crimp height during the crimping process is disclosed in U.S. Pat. Nos. 4,856,186 and 4,916,810 to Yeomans.

On the other hand many unsatisfactorily crimped connections will, nevertheless, exhibit a "correct" crimp height. A crimp height variance or other physical variation in the crimped terminal is not in and of itself the cause of a defective crimp connection, but rather, is indicative of another factor which causes the poor connection. Such factors include using the wrong terminal or wire size, missing strands of wire, wrong wire type, and incorrect stripping of insulation. Since such defective crimped connections frequently have the appearance of high quality crimped connections, it is difficult to identify these defects so that timely corrective action may be taken. Simple non-destructive means of detecting defectively crimped terminals by analyzing the crimping forces imposed on the terminal during the crimping operation are disclosed in U.S. Pat. Nos. 5,123,165 and 5,197,186 to Strong. However, estimates of crimp height and poor quality crimps based on force measurements are unreliable due to unexpected changes in the crimp force and crimping machine component positions. In addition, force based estimates of crimp height require complex computer systems to interpret force and position data to develop the estimated crimp height.

New technologies in ultrasonic monitoring have been proposed for use in crimp quality monitoring. For example, U.S. Pat. No. 7,181,942 describes an ultrasonic device and method for measuring crimp connections by comparing signals with signals from a previous crimp that was determined to be desirable through destructive testing.

A need remains for a crimp quality monitoring system that uses ultrasonic monitoring to determine crimp height of a crimped terminal as a measure of crimp quality.

BRIEF DESCRIPTION OF THE INVENTION

In an embodiment, a terminal crimping device is provided including crimp tooling including an anvil and a ram movable toward the anvil with a crimp zone being defined between the anvil and the ram configured to receive a wire and a terminal configured to be crimped to the wire by the crimp tooling. An ultrasonic transducer is coupled to at least one of the anvil and the ram that receives acoustic signals sent through the wire and terminal. A crimp quality module receives signals from the ultrasonic transducer. The crimp quality module determines a crimp height of the terminal based on the acoustic signal received by the ultrasonic transducer.

Optionally, the crimp height may be determined when the ram separates from the terminal. The crimp height may be determined based upon a transmission time of the acoustic signal from an ultrasonic transmitting transducer to the ultrasonic receiving transducer. The crimp height may be determined based upon a speed of sound transmission coefficient of the terminal and the wire. The speed of sound transmission coefficient may be determined by a calibration module. The speed of sound transmission coefficient may be specific to the materials of the terminal and the wire.

Optionally, the terminal crimping device includes an ultrasonic transmitting transducer coupled to at least one of the anvil and the ram. The ultrasonic transmitting transducer generates acoustic signals that are transmitted through the terminal and wire and transmitted through at least one of the anvil and the ram. The acoustic signals may be received at the ultrasonic receiving transducer.

Optionally, the crimp quality module may generate a crimp profile based upon the received acoustic signals. The crimp quality module may determine a crimp quality based on at least one profile characteristic of the crimp profile.

Optionally, the terminal crimping device may include a linear position module determining a position of at least one of the anvil and the ram. The crimp quality module may determine the crimp height of the terminal based on a position of at least one of the anvil and the ram. The linear position module may determine a separation distance between the anvil and the ram corresponding to a crimp height of the terminal. The crimp quality module may determine the time of separation between the terminal and the ram. The crimp quality module may determine the crimp height at the time of separation.

Optionally, the terminal crimping device may include a force detection module determining a force applied to the terminal by the crimp tooling. The crimp quality module may determine a crimp quality based on the crimp height and the force. The terminal crimping device may include multiple ultrasonic transducers transmitting and/or receiving acoustic signals. The crimp quality module may receive signals from the ultrasonic transducers. The crimp quality module may be configured to determine a shape of the crimped terminal based upon the received signals from the ultrasonic transducers.

In another embodiment, a terminal crimping device is provided including crimp tooling including an anvil and a ram movable toward the anvil with a crimp zone being defined between the anvil and the ram configured to receive a wire and a terminal configured to be crimped to the wire by the crimp tooling. An ultrasonic transducer is coupled to at least one of the anvil and the ram. The ultrasonic transducer receives acoustic signals sent through the wire and terminal. A crimp quality module receives signals from the ultrasonic transducer. A calibration module is coupled to the crimp quality module and receives signals from the crimp quality module. The calibration module determines a speed of sound transmission coefficient through the materials of the wire and terminal based on a measured crimp height of the terminal. The crimp quality module determines a crimp height of a second terminal based on the speed of sound of transmission coefficient through the materials of the wire and the terminal determined by the calibration module and based on the acoustic signal received by the ultrasonic transducer through the second terminal.

In a further embodiment, a method is provided of determining a crimp height of a crimped terminal. The method includes ultrasonically coupling an ultrasonic transducer to crimp tooling of a terminal crimping device, receiving acoustic signals at the ultrasonic transducer sent through a wire and terminal crimped by the crimp tooling, and determining a crimp height of the terminal based on the acoustic signal received by the ultrasonic transducer.

DETAILED DESCRIPTION OF THE INVENTION

Figure 1:
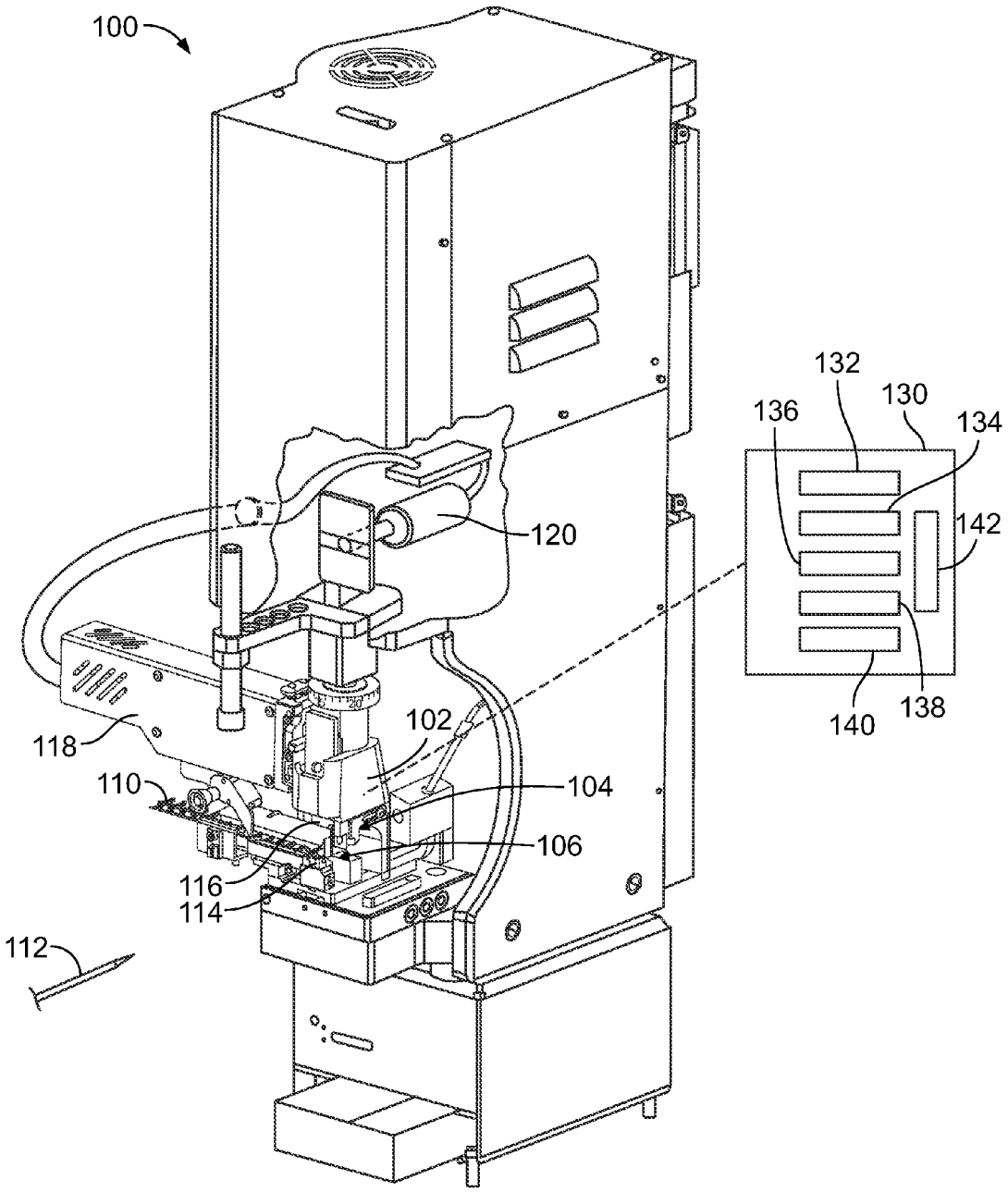
FIG. 1 is a perspective view of a terminal crimping device according to an exemplary embodiment.

FIG. 1 is a perspective view of a terminal crimping device 100 formed in accordance with an exemplary embodiment. The terminal crimping device 100 is used for crimping terminals to wires. In the illustrated embodiment, the terminal crimping device 100 is a bench machine having an applicator 102. Alternatively, the terminal crimping device 100 may be another type of crimping machine, such as a lead maker or a hand tool.

The terminal crimping device 100 includes crimp tooling 104 that is used to form the terminal during the pressing or crimping operation. The terminal crimping device 100 has a terminating zone or crimp zone 106 defined between the crimp tooling 104. Electrical connectors or terminals 110 and an end of a wire 112 are presented in the crimp zone 106 between the crimp tooling 104. In an exemplary embodiment, the crimp tooling 104 used for crimping includes an anvil 114 and a ram 116. The anvil 114 and/or the ram 116 may have removable dies that define the shape or profile of the terminal 110 during the crimping process. In the illustrated embodiment, the anvil 114 is a stationary component of the applicator 102, and the ram 116 represents a movable component. Alternatively, both the ram 116 and the anvil 114 may be movable. For example, with hand tools, typically both halves of the crimp tooling 104 are closed toward each other during the crimping operation.

The terminal crimping device 100 includes a feeder device 118 that is positioned to feed the terminals 110 to the crimp zone 106. The feeder device 118 may be positioned adjacent to the mechanical crimp tooling 104 in order to deliver the terminals 110 to the crimp zone 106. The terminals 110 may be guided to the crimp zone 106 by a feed mechanism to ensure proper placement and orientation of the terminal 110 in the crimp zone 106. The wire 112 is delivered to the crimp zone 106 by a wire feeder (not shown).

The terminal crimping device 100 may be configured to operate using side-feed type applicators and/or end-feed type applicators. Side-feed type applicators crimp terminals that are arranged side-by-side along a carrier strip, while end-feed type applicators crimp terminals that are arranged successively, end-to-end on a carrier strip. The terminal crimping device 100 may be configured to accommodate both side-feed and end-feed types of applicators, which may be interchangeable within the terminal crimping device 100.

During a crimping operation, the ram 116 of the applicator 102 is driven through a crimp stroke by a driving mechanism 120 of the terminal crimping device 100 initially towards the stationary anvil 114 and finally away from the anvil 114. Thus, the crimp stroke has both a downward component and an upward component. The crimping of the terminal 110 to the wire 112 occurs during the downward component of the crimp stroke. During the crimping operation, a terminal 110 is loaded onto the anvil 114 in the crimp zone 106, and an end of the wire 112 is fed within a crimp barrel of the terminal 110. The ram 116 is then driven downward along the crimp stroke towards the anvil 114. The ram 116 engages the crimp barrel of the terminal 110 and deforms (e.g. folds or rolls) the ends of the crimp barrel inward around the wire 112. The crimp tooling 104 crimps the terminal 110 onto the wire 112 by compressing or pinching the terminal 110 between the ram 116 and the anvil 114. The ram 116 then returns to an upward position. As the ram 116 moves upward, the ram 116 releases or separates from the terminal 110. In an exemplary embodiment, the resilient nature of the terminal 110 and/or wires 112 causes the terminal 110 to rebound slightly from the bottom dead center of the downward portion of the crimp stroke. The elastic yield or spring back of the terminal 110 will follow the ram 116 for a portion of the return or upward part of the stroke of the ram 116 until the terminal 110 reaches a final or stable size. At such point, the terminal 110 has a particular crimp height measured between the bottom and top most points of the terminal 110.

The operation of the terminal crimping device 100 is controlled by a control module 130. For example, the control module 130 may control the operation of the driving mechanism 120. The control module 130 may control the operation of the feeder device 118 and synchronizes the timing of the crimp stroke with the timing of a feed stroke of the feeder device 118. In an exemplary embodiment, the control module 130 includes a crimp quality module 132 that determines a crimp quality of the particular crimp. The terminal 110 may be discarded if the crimp quality does not meet certain specifications. In an exemplary embodiment, the crimp quality module 132 determines a crimp height of the terminal as a measure of crimp quality. The crimp quality module 132 may determine crimp quality based on other characteristics in addition to, or in the alternative to, the crimp height, such as a force measurement or force profile of the terminal during the crimp.

Optionally, the control module 130 may have a linear position module 134 for determining the crimp height, such as by determining a spacing distance between the ram 116 and the anvil 114. For example, after calibration, the linear position module 134 may be used to determine crimp height. The linear position module 134 may be used to determine the position of the ram 116 at a particular time (e.g. at bottom dead center or when the ram 116 separates from the terminal 110) for comparison of one crimp to the next, which may be a quality control check. The linear position module 134 may be used to determine when the crimp tooling is in motion, and thus operate other modules based on the signals from the linear position module 134.

Optionally, the control module 130 may have a force detection module 136 for determining a force applied to the terminal by the crimp tooling 104 during the crimping operation. The crimp quality module 132 may determine crimp quality based on the crimp height and the measured force. Optionally, the control module 130 may have an adjustment module 138 for adjusting the relative positions of the ram 116 and/or the anvil 114. Such adjustment may be performed using computer controlled positioners. Adjustment of the positions of the ram 116 and/or the anvil 114 may change the bottom dead center position of the ram 116 relative to the anvil 114. Adjustment of the positions of the ram 116 and/or the anvil 114 may change the crimp height of the terminal. Adjustments may be made based upon the crimp quality determined by the crimp quality module 132.

In an exemplary embodiment, the control module 130 includes an ultrasound module 140 for transmitting and receiving ultrasonic acoustic signals. The ultrasound module 140 may cause acoustic signals to be transmitted through the terminal 110 and the wire 112 during the crimping operation. The crimp quality module 132 may determine crimp quality based on the acoustic signals transmitted through the terminal 110 and the wire 112. The crimp quality module 132 may determine a crimp height of the terminal 110 based on the acoustic signals transmitted through the terminal 110 and the wire 112. The crimp quality module 132 may determine a shape of the crimped terminal based on the acoustic signals transmitted through the terminal 110 and the wire 112. The ultrasound module 140 may cause acoustic signals to be transmitted through the ram 116 and/or the anvil 114 in addition to the terminal 110 and the wire 112 during the crimping operation. For example, in some embodiments, the acoustic signals may be generated at a transducer in the ram 116, transmitted through the ram 116, through the terminal 110, through the wire 112 and through the anvil 114 and then received at a transducer in the anvil 114. In some embodiments, the acoustic signals may be generated at a transducer in the anvil 114, transmitted through the anvil 114, through the terminal 110, through the wire 112 and through the ram 116 and then received at a transducer in the ram 116. In some embodiments, the acoustic signals may be generated at a transducer in the ram 116, transmitted through the ram 116, through the terminal 110, through the wire 112 and then back through the ram 116 and then received at a transducer in the ram 116, which may be the same transducer that generated the acoustic signal. In some embodiments, the acoustic signals may be generated at a transducer in the anvil 114, transmitted through the anvil 114, through the terminal 110, through the wire 112 and then back through the anvil 114 and then received at a transducer in the anvil 114, which may be the same transducer that generated the acoustic signal.

Optionally, the control module 130 may have a calibration module 142 for calibrating one or more modules of the control module 130. For example, the calibration module 142 may be used to determine heights, distances, ultrasonic frequencies, coefficients of materials used in the system, and the like, which may be used by the crimp quality module 132 or other modules to perform calculations or in running algorithms to determine the crimp height or other characteristics of the system.

Optionally, the function of any of the modules may be combined into one or more other modules. For example, the calibration and crimp quality modules may combined into a single module, and the like.

Figure 2:
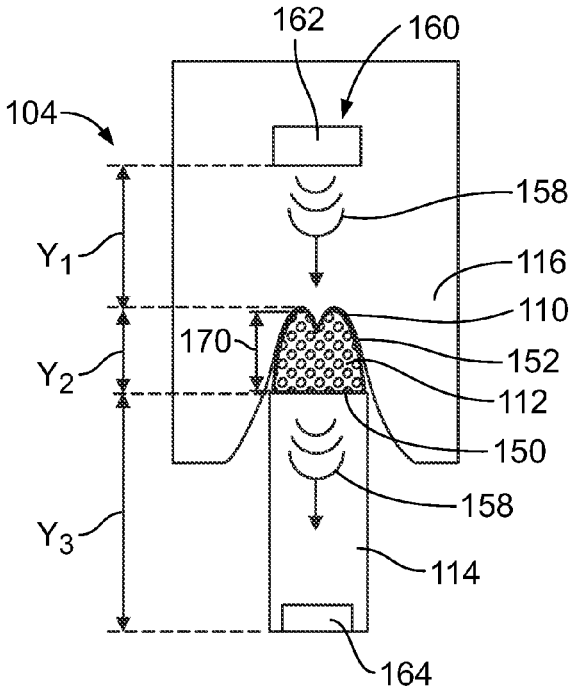
FIG. 2 illustrates a portion of the terminal crimping device showing ultrasonic transducers attached to an anvil and ram used to form a crimped terminal during a crimping operation.

FIG. 2 illustrates a portion of the terminal crimping device 100 showing the anvil 114 and the ram 116 used to form the crimp during the crimping operation. The crimp tooling 104 forms an F-crimp in the illustrated embodiment; however other shape crimp tooling may form crimps having other shapes in alternative embodiments.

The anvil 114 has a support surface 150 used to support the terminal 110. In the illustrated embodiment, the support surface 150 is flat and horizontal; however the support surface 150 may have other shapes and orientations in alternative embodiments. The terminal 110 rests on the support surface 150 as the ram 116 is moved through the crimp stroke.

The ram 116 has a forming surface 152 that engages the terminal 110 during the crimping process. The forming surface 152 presses the sidewalls of the terminal barrel inward during the crimping process. The forming surface 152 compresses the sidewalls against the wire 112 during the crimping process. When the ram 116 is in contact with the terminal 110, acoustic signals 158 may be transmitted across the forming surface 152 into the terminal 110 and wire 112. The acoustic signals 158 may be transmitted across the support surface 150 into the anvil 114. The acoustic signals 158 may be reflected at the interfaces defined at the forming surface 152 and support surface 150.

In an exemplary embodiment, the ultrasound module 140 (shown in FIG. 1) includes one or more ultrasonic transducers 160 that transmit and/or receive acoustic signals 158 in the ultrasonic frequency range. In the illustrated embodiment, the ultrasound module 140 includes an ultrasonic transmitting transducer 162 and an ultrasonic receiving transducer 164. The ultrasonic transmitting transducer 162 is coupled to the ram 116, while the ultrasonic receiving transducer 164 is coupled to the anvil 114. In other embodiments, the ultrasonic receiving transducer 164 may be coupled to the ram 116 and/or the ultrasonic transmitting transducer 162 may be coupled to the anvil 114. In other embodiments, rather than having dedicated transmitting and receiving transducers, either or both of the transducers 162, 164 may be capable of transmitting and receiving the acoustic signals 158. In other embodiments, only one transducer 162 or 164 is needed that is capable of transmitting and receiving the acoustic signals 158. The ultrasonic transducers 160 may be coupled to an outer surface of the crimp tooling 104. Alternatively, the ultrasonic transducers 160 may be embedded within the crimp tooling 104. The ultrasonic transducers 160 are ultrasonically coupled to the crimp tooling 104, wherein the acoustic signals 158 may be transmitted to or from the ultrasonic transducers 160 to or from the crimp tooling 104. The ultrasonic transducers 160 are ultrasonically coupled to the terminal 110 and wire 112 via the crimp tooling 104.

In an exemplary embodiment, the ultrasonic transducers 160 are piezoelectric transducers that convert electrical energy into sound. The piezoelectric transducers change size when a voltage is applied thereto. The ultrasound module 140 includes electric circuitry coupled to the ultrasonic transmitting transducer 162 to supply an alternating current across the ultrasonic transducer 162 to cause oscillation at very high frequencies to produce very high frequency sound waves. The ultrasonic receiving transducer 164 generates a voltage when force is applied thereto from the acoustic signals 158 and the electric signal generated at the ultrasonic receiving transducer 164 is transmitted by electric circuitry coupled thereto to the ultrasound module 140 and/or the crimp quality module 132 (shown in FIG. 1). Other types of ultrasonic transducers 160 other than piezoelectric transducers may be used in alternative embodiments, such as magnetostrictive transducers.

In an exemplary embodiment, the ultrasound module 140 is used to determine the crimp height of the formed wire 112 and terminal 110 by generating the ultrasonic acoustic signal 158 at the transmitting transducer 162. The acoustic signal 158 travels through the crimp tooling 104 and crimped terminal 110 and wire 112 in the form of a longitudinal sound wave, however the wave may be propagated in any direction.

The ultrasonic receiving transducer 164 receives the acoustic signal 158 and converts such signal to an electrical signal for processing, such as by the crimp quality module 132. Such process may be repeated approximately 500 or more times per crimp cycle.

A time T required for the ultrasonic acoustic signal 158 to travel through the ram 116 (e.g. along distance Y1), thorough the terminal 110 and wire 112 (e.g. along distance Y2), and through the anvil 114 (e.g. along distance Y3) can be accurately measured using ultrasonic signal generation and processing equipment at the ultrasound module 140 and/or crimp quality module 132. The distances of the ram 116 and anvil 114, namely Y1 and Y3, are fixed by the crimp tooling 104, while the distance Y2 of the terminal 110 and wire 112 changes during the crimp process. A time T1 for the acoustic signal 158 to travel the distance Y1 can be measured or determined, and is based on a speed of sound transmission coefficient of the material of the ram 116. A time T2 for the acoustic signal 158 to travel the distance Y2 can be measured or determined, and is based on a speed of sound transmission coefficient of the material of the terminal 110 and the wire 112. A time T3 for the acoustic signal 158 to travel the distance Y3 can be measured or determined, and is based on a speed of sound transmission coefficient of the material of the anvil 114.

The total time T to send a signal from the transmitting transducer 162 to the receiving transducer 164 varies directly as the result of a change in the Y2 distance. The Y2 distance is a measure of a crimp height 170 of the terminal 110. The crimp height 170 (e.g. Y2 distance) can be measured at any point during the crimping process. For example, the crimp height 170 can be measured at the bottom dead center of the ram 116, which corresponds to the minimum measured crimp height 170 during the crimping process. The crimp height 170 can be measured at the moment of separation of the ram 116 from the terminal 110 as the acoustic signal 158 will cease to propagate from the transmitting transducer 162 to the receiving transducer 164 when the ram 116 is separated from the terminal 110. The last acoustic signal 158 received generally corresponds to the stable crimp height or final crimp height of the crimped terminal 110.

In an exemplary embodiment, the distance Y1 between the transmitting transducer 162 and the forming surface 152 may be measured during a calibration process using the calibration module 142. The distance Y1 may be measured manually, such as using a tool such as a micrometer. The distance Y1 may be measured by other means, such as by using the ultrasound module 140. For example, the time required to send a signal through the Y1 distance twice can easily be measured by sending a signal from the transducer 162 and then waiting for the echoed signal to return to the transducer 162 after bouncing off the forming surfaces 152. The total time is divided by half to get the one way transmitted time T1. Such process may be performed prior to the crimp process beginning, such as during a calibration process, such that the crimp surface may reflect a stronger signal, rather than transmitting the acoustic signal 158 through the forming surface 152 into the terminal 110. The distance Y1 may be calculated based on the time T1 using a speed of sound transmission coefficient through the known material of the ram 116.

In an exemplary embodiment, the distance Y3 between the transducer 162 and the support surface 150 may be measured during a calibration process using the calibration module 142. The distance Y3 may be measured manually, such as using a tool such as a micrometer. The distance Y3 may be measured by other means, such as by using the ultrasound module 140. For example, the time required to send a signal through the Y3 distance twice can easily be measured by sending a signal from the transducer 164 and then waiting for the echoed signal to return to the transducer 164 after bouncing off the support surface 150. The total time is divided by half to get the one way transmitted time T3. Such process may be performed prior to the crimp process beginning, such as during a calibration process, such that the crimp surface may reflect a stronger signal, rather than transmitting the acoustic signal through the support surface 150 into the terminal 110. The distance Y3 may be calculated based on the time T3 using a speed of sound transmission coefficient through the known material of the anvil 114.

The wire 112 and terminals 110 may be manufactured from various types of material, such as copper, copper alloys, aluminum, aluminum alloys, and the like. The speed at which the acoustic signal 158 travels through the crimped wire and terminal needs to be determined for accurate measurement of the crimp height 170 (e.g. the distance Y2). In an exemplary embodiment, to determine the speed of sound through the wire 112 and through the terminal 110, a test or calibration crimp is performed and the crimp height of the calibration crimp as determined by manual measurement using a tool such as a micrometer or by using a linear encoder that determines a position of the ram 116 relative to the anvil 114. During the calibration crimp the total time required to transmit the ultrasound signal between the transducers 162, 164 is measured and recorded. The crimp tool transmit times T1 and T3 for the ram 116 and anvil 114 are known and constant (e.g. known based on the calibration process described above). The crimp tool transmit times T1 and T3 are subtracted from the total time T. The remaining time T2 is the time the acoustic signal 158 is in the crimped terminal. The time T2 corresponds to the measured calibration crimp height 170 and the speed of sound transmission coefficient of the particular materials used for the terminal 110 and wire 112 may be calculated based on the calibration crimp height 170 and the time T2.

For future crimps using the same material wires and same material terminals, the speed of sound transmission coefficient calculated during the calibration process may be used to determine the crimp height 170 thereof based on the measured time T2 performed during the crimping process. The speed of sound transmission coefficient is used as a constant to calculate the distance Y2 of future crimps. As the distance Y2 is adjusted or changed during the crimping process, the total time T required for the ultrasonic acoustic signal 158 to pass from the transmitting transducer 162 to the receiving transducer 164 will change directly with Y2. Once the speed of sound transmission coefficient constant (for the particular wire and terminal material) is known the process of determining the Y2 distance can be performed as fast as each ultrasonic acoustic signal 158 is generated and processed for the total transmit time. The instant measure of crimp height 170 may be calculated throughout the crimp process. The terminal 110 and wire 112 are subject to elastic yield or spring back. After the ram 116 passes through the bottom dead center, the Y2 distance will start to grow larger as the terminal 110 springs back. At a point past bottom dead center, the terminal 110 and wire 112 return to a stable size and the ram 116 separates from the terminal 110 preventing the transmission of the ultrasonic acoustic signal 158. The point of separation can be determined using the ultrasonic processing equipment and the Y2 distance can be calculated at the point of separation, which corresponds to the final crimp height 170. Since the terminal 110 has returned to a stable size at the point of separation, the final collected Y2 measurement is equal to the final crimp height 170 of the terminal 110 and wire 112.

Figure 3:
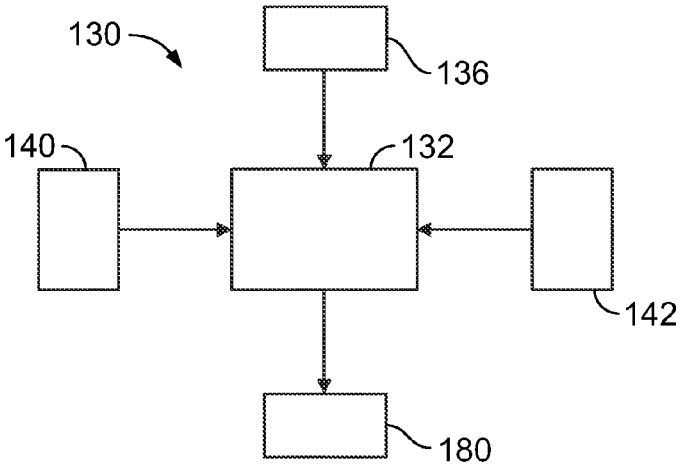
FIG. 3 illustrates an exemplary embodiment of a control module of the terminal crimping device.

FIG. 3 illustrates an exemplary embodiment of the control module 130. The crimp quality module 132 receives signals from the ultrasound module 140. For example, signals relating the transmitting and receiving of the ultrasonic acoustic signals 158 (shown in FIG. 2) are sent to the crimp quality module 132. The signals from the ultrasound module 140 are analyzed, such as to determine the crimp height of the crimped terminal. For example, the crimp quality module 132 may determine the total transmission time T or the transmission time T2 through the crimped terminal, based on the signals from the ultrasound module 140. Based on the transmission time, the crimp height of the crimped terminal may be determined by the crimp quality module 132. Optionally, the crimp quality module 132 may use a speed of sound transmission coefficient for the terminal and wire to determine the crimp height.

The speed of sound transmission coefficient may be determined by the calibration module 142 and sent to the crimp quality module 132 to use in the crimp height calculation. For example, during a calibration process, the crimp height of a calibration or test crimp may be measured and correlated with the transmission time of the acoustic signals during the calibration crimping process to determine the speed of sound transmission coefficient through the particular material of the terminal and wire. Such speed of sound transmission coefficient may be used for the future crimps in the crimp height calculation. Other means or processes may be used to determine the speed of sound transmission coefficient. For example, the speed of sound transmission coefficient may be estimated based on the material characteristics of the materials of the terminal and wire. Such estimations are less accurate but quicker to obtain and use. In other alternative embodiments, the calibration module 142 may be used to determine other constants or coefficients for use in the algorithms used by the crimp quality module 132 to determine crimp height or other meaningful characteristics of the crimped terminal.

Optionally, the crimp quality module 132 may receive signals from the force detection module 136 that relate to forces measured in the crimped terminal during the crimping process. The crimp quality module 132 may determine a crimp profile of the crimped terminal based on the force measurements. The crimp quality module 132 may determine a crimp profile of the crimped terminal based on the force measurements and the crimp height. Signals from the ultrasound module 140 may be used by the crimp quality module 132 to determine which force signals to use in determining crimp quality of the crimped terminal. For example, at the moment of separation between the ram 116 (shown in FIG. 2) and the terminal 110 (shown in FIG. 2), the ultrasonic acoustic signals 158 cease to transmit from the ram through the terminal. The force measurements used by the crimp quality module 132 may cease at the moment of separation, determined by the ultrasound module 140.

The crimp quality module 132 may output data to another component or module of the control module 130, such as a controller 180. The controller 180 may control one or more operations of the terminal crimping device 100 based on the outputs. For example, the controller 180 may cause certain crimps to be discarded if the crimp quality module 132 determines such crimps are defective or inferior. The controller 180 may adjust the relative positions of the ram 116 and anvil 114 (both shown in FIG. 2) to control the crimp height, based on the outputs. The adjustment may be made by sending a signal to the adjustment module 138 (shown in FIG. 1). For example, the anvil 114 may be adjusted up or down to shorten or lengthen the crimp height for a given terminal and wire combination.

Figure 4:
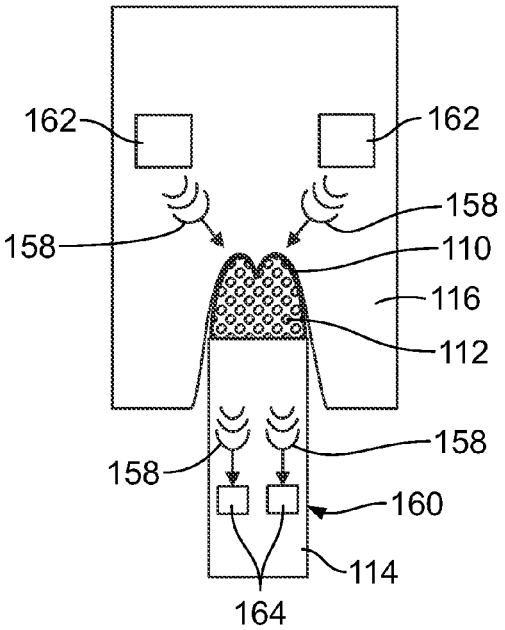
FIG. 4 illustrates a portion of the terminal crimping device showing ultrasonic transducers attached to an anvil and ram used to form a crimped terminal during a crimping operation.

FIG. 4 illustrates a portion of the terminal crimping device 100 showing the anvil 114 and the ram 116 used to form the crimp during the crimping operation. Multiple ultrasonic transducers 160 are illustrated in FIG. 4, with two ultrasonic transmitting transducers 162 on the ram 116 and two ultrasonic receiving transducers 164 on the anvil 114. Any number of transmitting and receiving transducers 162, 164 may be provided on any of the crimp tooling 104 pieces. For example, a transmitting transducer 162 may be coupled to the ram 116 on one side of the terminal 110 and a receiving transducer 162 may be coupled to the ram 116 on the other side of the terminal 110 with the corresponding acoustic signals 158 never passing through the anvil 114. The transducers 160 may be configured to both transmit and receive acoustic signals 158. Additionally, more than two crimp tooling 104 components may be used in other embodiments, such as four pieces that are used to crimp the terminal 110 to the wire 112.

In an exemplary embodiment, both receiving transducers 164 receive the ultrasonic acoustic signals 158 from both transmitting transducers 162. Based on the shape of the tooling dies and thus the terminal 110 and wire 112, the acoustic signals 158 may have different travel times to the receiving transducers 164. The crimp quality module 132 (shown in FIG. 1) may be used to determine the shape of the crimped terminal at any given time based on the acoustic signals received at the different receiving transducers 164. In other embodiments, a single receiving transducer 164 may be used to determine the shape of the crimped terminal by using any number of transmitting transducers 162. In other embodiments, multiple receiving transducers 164 may be used to determine the shape of the crimped terminal by using a single transmitting transducer 162.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A terminal crimping device comprising:

a crimp tooling comprising an anvil and a ram movable toward the anvil, a crimp zone being defined between the anvil and the ram configured to receive a wire and a terminal configured to be crimped to the wire by the crimp tooling;

an ultrasonic transducer coupled to at least one of the anvil and the ram, the ultrasonic transducer receiving acoustic signals sent through the wire and terminal; and a crimp quality module receiving signals from the ultrasonic transducer, the crimp quality module determining a crimp height of the terminal based on the acoustic signal received by the ultrasonic transducer.

2. The terminal crimping device of claim 1, wherein the crimp height is determined when the ram separates from the terminal.

3. The terminal crimping device of claim 1, wherein the crimp height is determined based upon a transmission time of the acoustic signal from an ultrasonic transmitting transducer to the ultrasonic receiving transducer.

4. The terminal crimping device of claim 1, wherein the crimp height is determined based upon a speed of sound transmission coefficient of the terminal and the wire.

5. The terminal crimping device of claim 4, wherein the speed of sound transmission coefficient is determined by a calibration module, the speed of sound transmission coefficient being specific to the materials of the teiminal and the wire.

6. The terminal crimping device of claim 1, further comprising an ultrasonic transmitting transducer coupled to at least one of the anvil and the ram, the ultrasonic transmitting transducer generating acoustic signals transmitted through the terminal and wire and transmitted through at least one of the anvil and the ram, the acoustic signals being received at the ultrasonic receiving transducer.

7. The terminal crimping device of claim 1, wherein the crimp quality module generates a crimp profile based upon the received acoustic signals, the crimp quality module determining a crimp quality based on at least one profile characteristic of the crimp profile.

8. The terminal crimping device of claim 1, further comprising a linear position module determining a position of at least one of the anvil and the ram, the crimp quality module determining the crimp height of the terminal based on a position of at least one of the anvil and the ram.

9. The terminal crimping device of claim 8, wherein the linear position module determines a separation distance between the anvil and the ram corresponding to a crimp height of the terminal, the crimp quality module determining the time of separation between the terminal and the ram, the crimp quality module determining the crimp height at the time of separation.

10. The terminal crimping device of claim 1, further comprising a force detection module determining a force applied to the terminal by the crimp tooling, the crimp quality module determining a crimp quality based on the crimp height and the force.

11. The terminal crimping device of claim 1, further comprising multiple ultrasonic transducers at least one of transmitting and receiving acoustic signals, the crimp quality module receiving signals from the ultrasonic transducers, the crimp quality module being configured to determine a shape of the crimped terminal based upon the received signals from the ultrasonic transducers.

12. A terminal crimping device comprising:

a crimp tooling comprising an anvil and a ram movable toward the anvil, a crimp zone being defined between the anvil and the ram configured to receive a wire and a terminal configured to be crimped to the wire by the crimp tooling;

an ultrasonic transducer coupled to at least one of the anvil and the ram, the ultrasonic transducer receiving acoustic signals sent through the wire and terminal;

a crimp quality module receiving signals from the ultrasonic transducer; and a calibration module coupled to the crimp quality module and receiving signals from the crimp quality module, the calibration module determining a speed of sound transmission coefficient through the materials of the wire and terminal based on a measured crimp height of the terminal.

13. The terminal crimping device of claim 12, wherein the crimp quality module determines a crimp height of a second terminal based on the speed of sound of transmission coefficient through the materials of the wire and the terminal determined by the calibration module and based on the acoustic signal received by the ultrasonic transducer through the second terminal.

14. The terminal crimping device of claim 12, wherein the crimp quality module determines a crimp height of subsequent crimps based on a time of acoustic signal transmission through the terminal and wire and based on the speed of sound of transmission coefficient through the materials of the wire and the terminal determined by the calibration module.

* * * * *